United States Patent [19]

Krob et al.

[11] 4,355,817

[45] Oct. 26, 1982

[54] SKI BRAKE

[75] Inventors: Erwin Krob, Vienna; Erwin Weigl, Brunn am Gebirge, both of Austria

[73] Assignee: TMC Corporation, Baar, Switzerland

[21] Appl. No.: 206,102

[22] Filed: Nov. 12, 1980

Related U.S. Application Data

[63] Continuation of Ser. No. 786,376, Apr. 11, 1977, abandoned.

[30] Foreign Application Priority Data

Apr. 16, 1976 [AT] Austria ..... 2853/76

[51] Int. Cl.[3] ..... A63C 7/10

[52] U.S. Cl. ..... 280/605; 280/633; 280/636

[58] Field of Search ..... 280/605, 604, 633, 617, 280/636; 9/310 A

[56] References Cited

U.S. PATENT DOCUMENTS

| | | | |
|---|---|---|---|
| 3,049,734 | 8/1962 | Johnson et al. | 9/310 |
| 3,531,135 | 9/1970 | Salomon | 280/633 |
| 3,580,597 | 5/1971 | Beyl | 280/633 |
| 3,785,666 | 1/1974 | Salomon | 280/633 |
| 3,940,158 | 2/1976 | Wehrli | 280/605 |
| 3,992,030 | 11/1976 | Salomon | 280/605 |
| 4,059,284 | 11/1977 | Schwarz | 280/605 |

FOREIGN PATENT DOCUMENTS

| | | | |
|---|---|---|---|
| 2413099 | 10/1975 | Fed. Rep. of Germany | 280/605 |
| 2531466 | 2/1976 | Fed. Rep. of Germany | 280/605 |
| 2278363 | 2/1976 | France | 280/605 |

*Primary Examiner*—David M. Mitchell

*Attorney, Agent, or Firm*—Blanchard, Flynn, Thiel, Boutell & Tanis

[57] ABSTRACT

A ski brake construction having a pair of blade members which are located on laterally opposite sides of the ski and can be pivoted between a cocked or ready or downhill position wherein the blade members extend approximately parallel with respect to the upper surface of the ski and a braking position wherein the blade members extend approximately perpendicularly with respect to the upper surface of the ski. The blade members are pivotally secured to a mounting device and are movable about the axis of two axles, one of which is stationary and the other of which is movable. The movable axle is slidable in a slot provided in the mounting device.

2 Claims, 10 Drawing Figures

SKI BRAKE

This is a continuation, of application Ser. No. 786 376, filed Apr. 11, 1977, now abandoned.

FIELD OF THE INVENTION

The invention relates to a ski brake having two wings which extend laterally with respect to the ski and can be pivoted about two axes which are arranged spaced from one another, which wings extend in the braking position approximately perpendicularly and in the cocked or ready or downhill position approximately parallel with respect to the upper surface of the ski.

BACKGROUND OF THE INVENTION

Such a ski brake is described for example in German OS No. 2 417 279. However, in this known construction only one wing is active on one side of the ski. However, a construction is already known on the market in which the ski brake has wings on both sides of the ski and in which, similar to the mentioned reference, both can be pivoted about two stationary axles. The operation of both known constructions is similar; by pressing down the area which is remote from the braking blade, a tension is produced in parts which consist in the known constructions of spring steel wire, which tension after release of the area held down by the ski boot causes a pivoting of the wings about the axes of rotation and causes the braking blade or the braking blades to pivot to a position perpendicular to the running direction of the ski and to effect a braking of the ski which has come free from the ski boot and thus from the skier.

Both known designs have the disadvantages that the largest force for holding the ski brake down must be produced, in the ready position of the ski brake, onto the holding area thereof. Since the safety ski binding must release the ski boot upon occurrence of outside forces of a certain magnitude, it is easily understandable that an additional no longer neglectable force can cause interferences in the release operation.

A further disadvantage consists in the spring wire which is used having a sufficient strength necessary to avoid as much as possible deformations which can occur both during the operation and also during the braking process. The result of using brake parts which consist of strong spring steel wire is a braking of the skis which is too strong and in most cases undesired because the skier who has come free from the ski has a longer stopping distance and this will cause the skier to come to a stop often far away from the ski. He then must climb a route on a steep hill until he returns to the skis.

The purpose of the invention is to overcome in a device of the above-mentioned type these and further disadvantages and to produce a ski brake which can be held in the ready position with forces which are neglectable for the release operation and can be produced without any damage or danger of deformation of thinner material and still be able to keep the stopping distance within the frame of values which have been found through tests.

The purposes are achieved inventively by supporting one axle stationarily on the ski and the other axle movably in longitudinal direction of the ski and the distance between the two axles is reduced from the braking position into the ready position.

The purposes are attained by the inventive construction disclosed herein. The slidable arrangement of one of the two axles has the consequence that the original distance between the two axles is reduced during a pressing down of the operating area by the ski boot toward the upper surface of the ski and in the ready position the two axles lie as close as possible side-by-side. Thus the force needed for holding operating area down is reduced because no additional torsion force exists between the axles. Therefore, one need only rely on the summation of the down-holding forces which are needed for the two wings. If the wings consist of spring steel wire, then they can be made of a substantially thinner material so that braking does not take place jerkily. If the wings consist of a flat material, for example sheet metal, and the second axle is defined by the interpositioning of a spring on the flat part, then the necessary stopping distance can be determined by suitably choosing the spring to be used. This construction is also a subject matter of the present invention.

BRIEF DESCRIPTION OF THE DRAWINGS

Further advantages and details of the inventive ski brake will be described more in detail hereinafter with reference to the drawings which illustrate several exemplary embodiments.

In the drawings.

DETAILED DESCRIPTION

Figure 1:
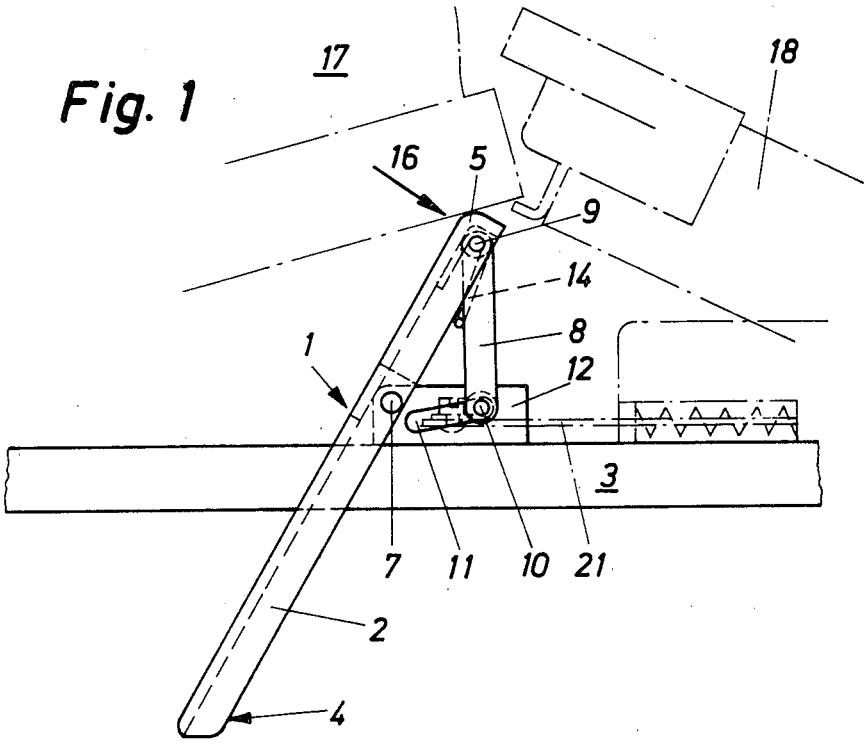
FIGS. 1 to 3 illustrate a first exemplary embodiment of the ski brake in which the wings consist of a flat part, FIG. 1 illustrating a side elevational view of the ski brake in the braking position and FIGS. 2 and 3 illustrating side and top views, respectively, of the ski brake in the cocked or ready position.

Corresponding parts are identified with the same reference numerals in the description; parts which have the same function, however, and are designed differently, will have a prime (') suffix.

Figure 2:
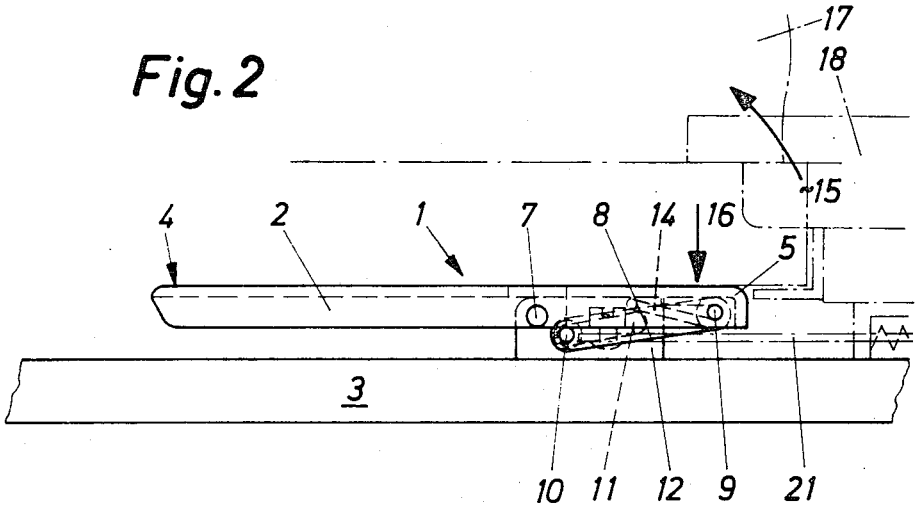
Figure 3:
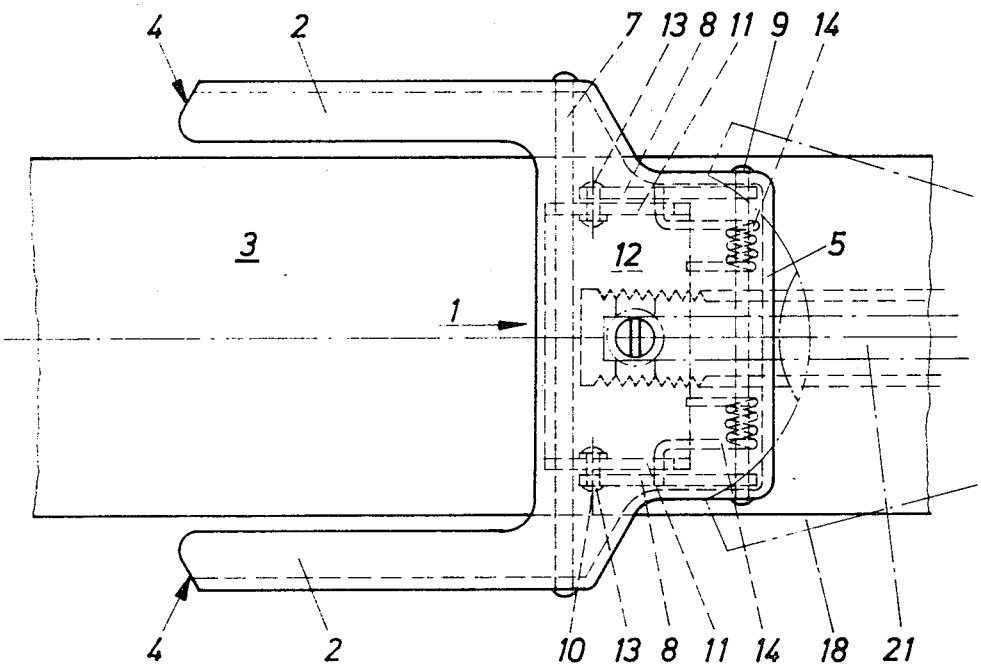

The ski brake embodying the invention is identified as a whole by the reference numeral 1 and has, according to the exemplary embodiment illustrated in FIGS. 1 to 3, wings 2 which extend on both longitudinal sides of the ski 3 and are designed at their ends like braking blades 4. The end of the wings 2 remote from the braking blades 4 is closed and forms a stepping area 5 on which a ski boot is to become engaged, which ski boot is fragmentarily indicated in FIGS. 1 and 2 and the force generated thereby being indicated by means of an arrow 6 in FIG. 2. The ski brake 1 is located between ski binding parts normally provided on the ski 3 and which are here not shown. The fixed or clamped position of the ski boot, which for the ski brake 1 is the cocked or ready position, is shown in FIGS. 2 and 3. The braking position is shown in FIG. 1. A comparison of FIG. 1 on the one hand, and the two FIGS. 2 and 3 on the other hand, illustrate that the pivot axle 7 is stationary and serves to pivotally connect the wings 2 to a mounting device 12 secured to the upper surface of the ski 3. The stepping area 5 is connected to the mounting device 12 by means of links 8 pivotal about a second axle 10 guided in a slot 11 in the mounting plate 12. In the present exemplary embodiment, two links 8 are arranged on the sides of the stepping area 5 and are each held in engagement with a slot 11 on opposite sides of the mounting device 12. The sliding axles 10 are defined by two bolts 13. The connection between the stepping area 5 and the links 8 is provided by a hinge pin 9; torsion springs 14 are arranged about the two hinge pins 9 between the links 8 and the stepping area 5. It will be easily recognized that when the action of the force which is indicated with the arrow 6 in FIG. 2 stops, the two torsion springs 14 will pivot the stepping area 5 in the direction of the arrow 15 about the stationary axle 7, and the two bolts 13 will slide in the slots 11. If the position shown in FIG. 1 is reached, the ski brake 1 will be in the braking position.

Figure 4:
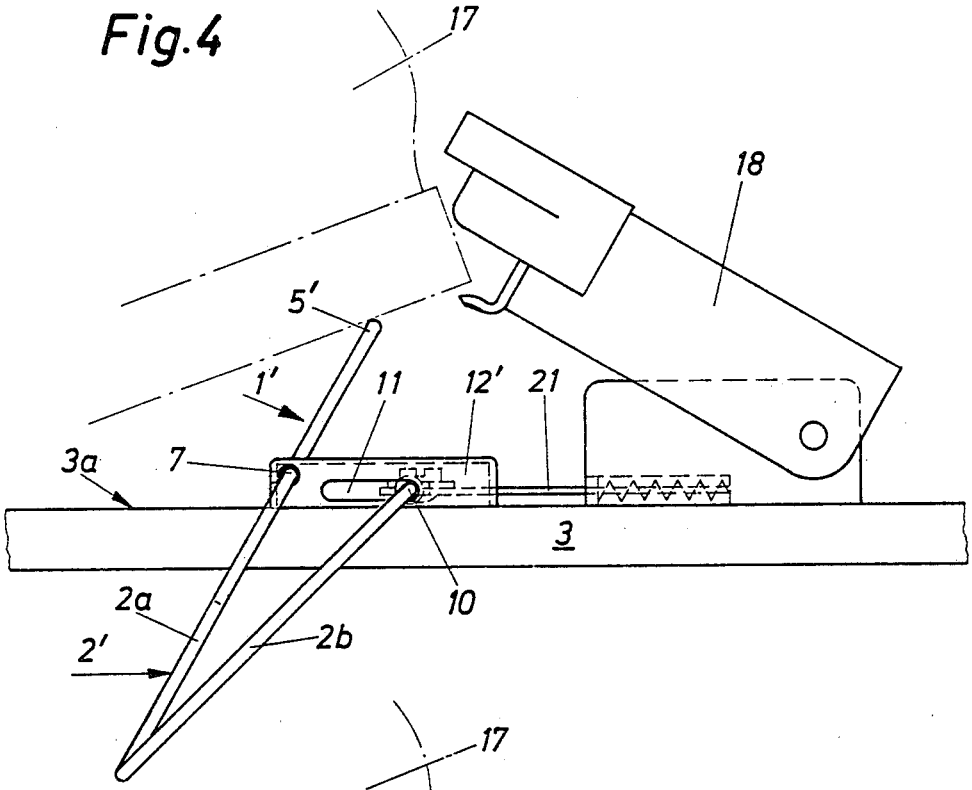
FIGS. 4 to 6 illustrate a second exemplary embodiment, in which the entire ski brake consists of a single piece of spring steel wire, FIG. 4 illustrating a side elevational view of the ski brake in the braking position and FIGS. 5 and 6 illustrating side and top views, respectively, of the ski brake in the cocked or ready position.
Figure 5:
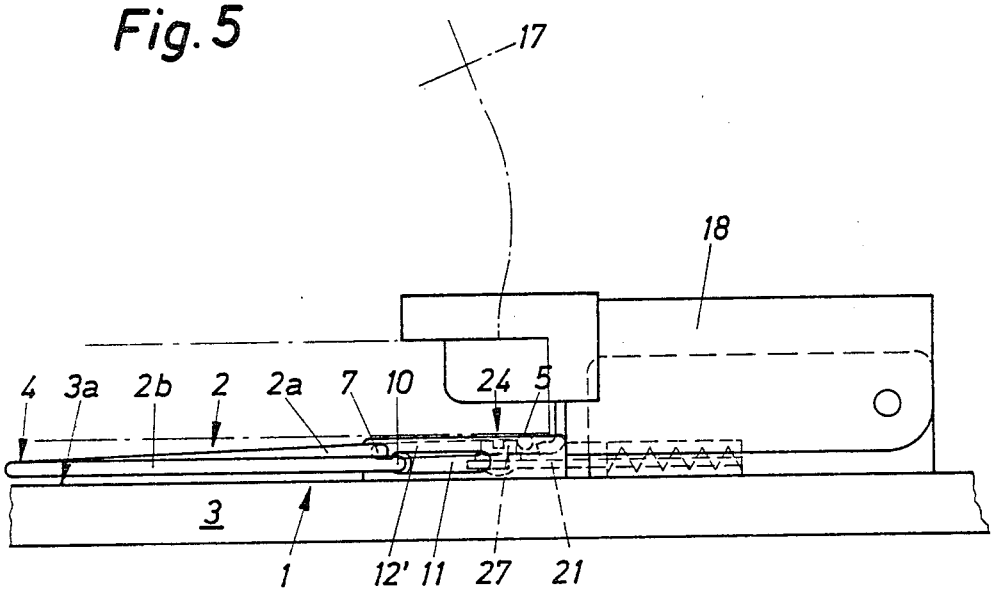
Figure 6A:
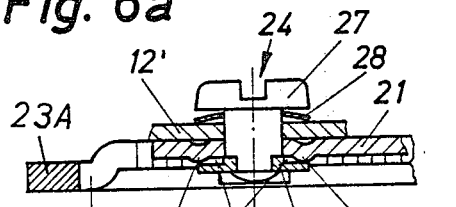
FIG. 6*a* is a longitudinal sectional view of a fragment of FIG. 6.
Figure 6:
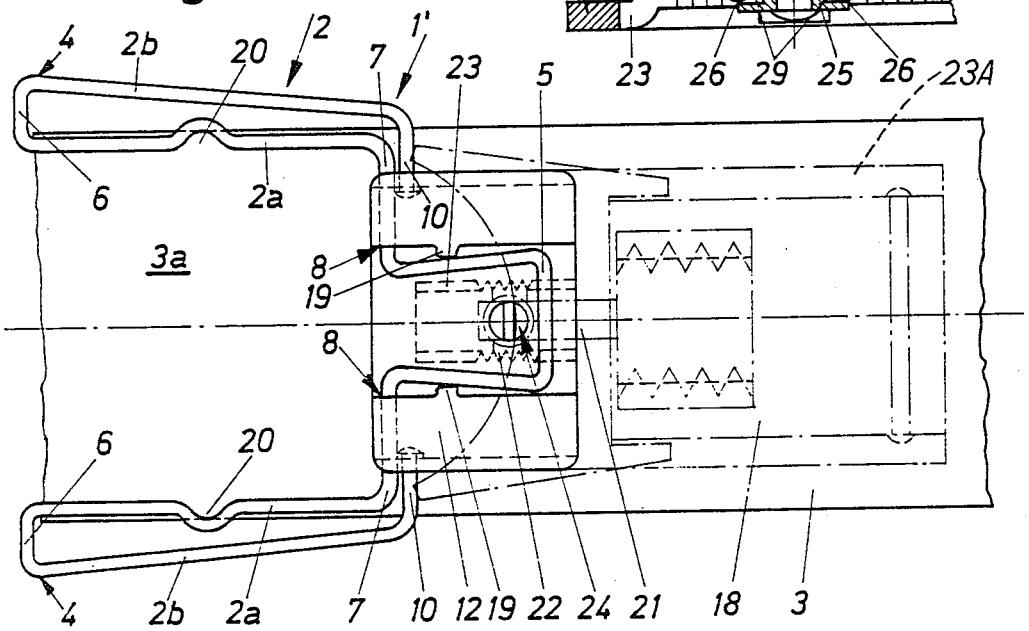

In the second exemplary embodiment according to FIGS. 4 to 6, the ski brake 1' is made of a single piece of spring steel wire. In this exemplary embodiment, the stationary axle 7 is formed by a wing part **2*a* and the free ends of the other wing part 2*b* form the sliding axle 10. The entire wing 2' has, therefore, in the areas of the free ends of each of the two braking blades 4 a bight portion 16 which form the actual torsion parts of the ski brake 1'. The stepping area 5' is here designed as a closed U-shaped bar. This exemplary embodiment further illustrates a ski boot 17 and a ski binding part 18 to facilitate a still better recognition of the mode of operation of the ski brake 1'**.

The mounting device 12' has in the present case two inwardly projecting shoulders 19 which effect during a stepping down by the ski boot onto the stepping area 5' a specified amount of pulling in of the two braking wings 2' above the upper surface of the ski. This will be particularly recognized in FIG. 6. Furthermore from FIG. 6, crimps 20 are formed in the spring wire and permit a uniting of the ski brakes arranged on the two skis. In this way both of the skis are attached together since the wing parts **2*b* of the one ski brake fasten in the crimps of the wing parts 2*a*** of the other ski brake and rest in this position by friction and spring power.

In particular from FIGS. 6 and **6*a* one can well recognize that the mounting device 12' is connected to the ski binding part 18 by means of a connecting piece 21. The connecting piece permits during an adjustment of the ski binding part 18, to accommodate a different length boot, a simultaneous adjustment of the mounting device 12' and thus the ski brake 1'. For the purpose of locking the mounting device 12' in the desired position, the connecting piece 21 has at its end adjacent the mounting device 12' a toothed detent member or releasable locking member 22 having several teeth thereon which is inserted into a toothed serrated slot 23. The serrated slot 23 is part of the base plate 23A secured to the ski by means not shown in detail. The locking structure which is shown particularly in FIG. 6*a* and which as a whole is identified by a reference numeral 24 consists of a clamping bolt 27 which carries at its downwardly projecting end a clamping disk 25 riveted thereto. The head of the clamping bolt 27 is resiliently raised and supported by a spring plate 28. The lower side of the connecting piece 21 has locking noses 26 thereon which are received in associated recesses 29 of the clamping disk 25 when in the locking position. If an adjustment is desired, then the head of the clamping bolt 27 is rotated 90° by means of a suitable tool, for example by means of a coin, which causes the clamping disk 25 to be moved parallel with respect to the longitudinal extent of the connecting piece 21 and permits a removal of the mounting device 12' from the base plate 23A and subsequently moving same into a different position and then by rotating the clamping bolt 27** re-engagement is brought about.

Further details and the type of operation are similar to the exemplary embodiment illustrated in FIGS. 1 to 3.

Figure 7:
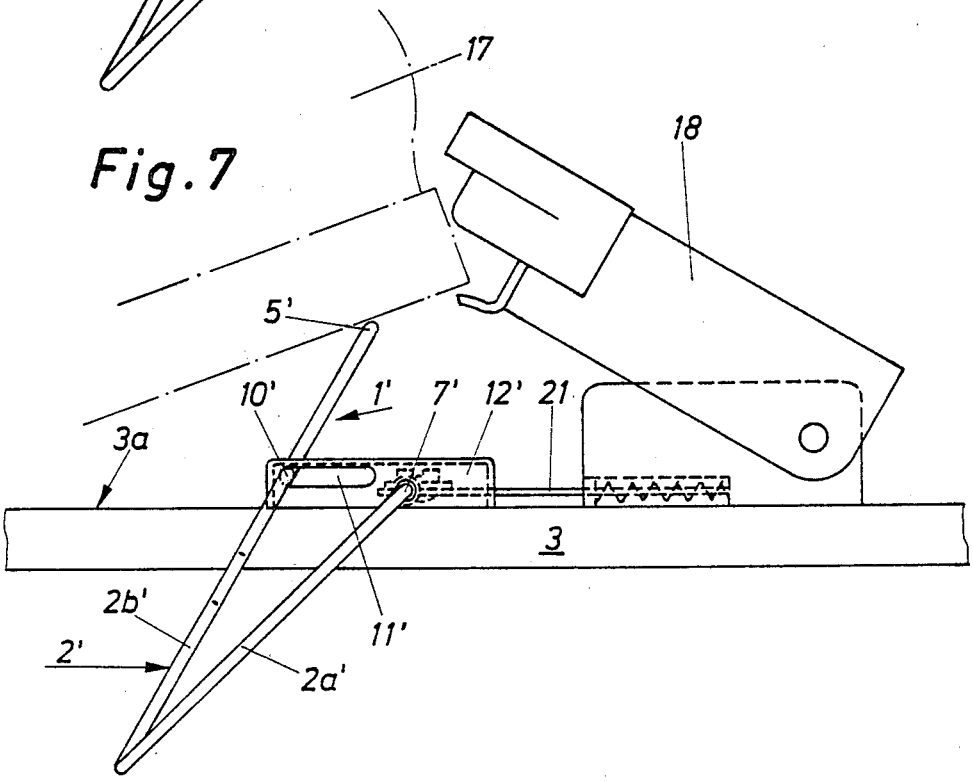
FIG. 7 illustrates a third exemplary embodiment similar to FIG. 4, however, with an exchange of the stationary and slidingly arranged axes.

In the exemplary embodiment according to FIG. 7, the structure is similar to the second exemplary embodiment, however with the difference that the position of the stationary axle and the sliding axle are interchanged. Due to the fact that here the sliding axle forms the fulcrum point of the ski brake, a continuous shifting of the axis of rotation is assured.

Figure 8:
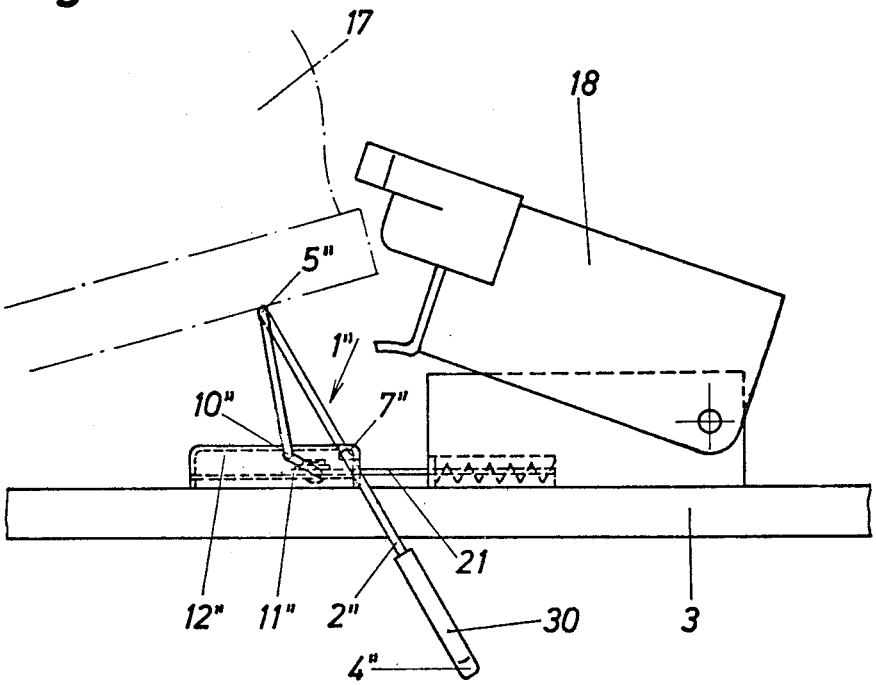
FIGS. 8 and 9 illustrate a fourth exemplary embodiment having two-part constructed braking wings, wherein the braking mandrels point in the ready position toward the ski end, wherein the braking position is illustrated in FIG. 8 which is a side elevational view and FIG. 9 which is a cross-sectional view.
Figure 9:
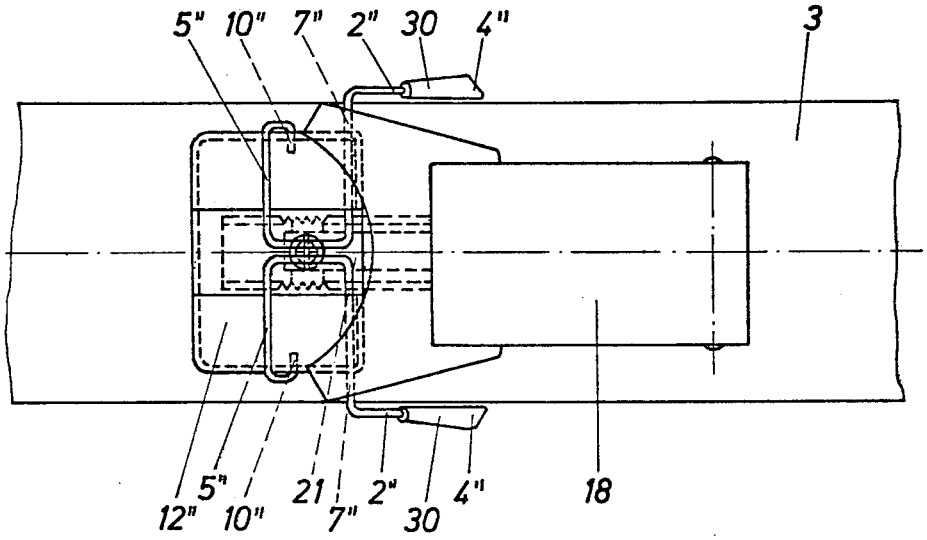

In the fourth exemplary embodiment according to FIGS. 8 and 9, the ski brake 1'' is made of two parts, however, both parts consisting of spring steel wire. The arrangement is such that when the wings 2'' are pulled in, the two braking blades 4'' extend in a direction opposite to the movement of the skis 3. This primarily has the psychological effect that the skier will not think that he will get the forwardly extending wings caught on an obstacle on the ground. However, it is also advantageous to make this arrangement because such a catching indeed cannot occur. It will be particularly recognized from FIG. 8 that the slot 11'' is sloped with respect to the ski surface; disregarding this the extent of the slot 11'' is directed toward the direction of the ski length. It must further be remarked that the wing ends are coated with a covering material 30. The operation of this construction is similar to the exemplary embodiment illustrated in FIGS. 4 to 6.

The invention is not limited to the listed exemplary embodiments. A number of variations are possible without departing from the scope of the invention. It is, for example, conceivable to cover around only the one wing part when the brake wings are split or also to cover the braking blades with a solid, however flexible, material. It is furthermore conceivable to design the length of the wings variably. The braking action can then be adjusted separately depending on the different skis. It is, however, also conceivable to vary the described constructions among one another.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski brake for use on a ski to effect a braking of said ski following a release of a ski boot from engagement with a ski binding, said ski binding being supported for movement lengthwise of said ski, comprising:

a base plate mounted on said ski and having an elongated slot therein extending parallel to the longitudinal axis of said ski;

mounting means;

bearing means on said mounting means;

a brake member having axle means received in said bearing means for pivotally securing said brake member to said mounting means and for facilitating movement of said braking member between a retracted position and a braking position, said braking member having a pair of braking wings and a pedal member, said pedal member being located above the upper surface of said ski and said braking wings each being located on opposite lateral sides of said ski and said pedal member;

resilient means continually urging said brake member toward said braking position; and connecting means for connecting said mounting means to said ski binding to facilitate a simultaneous movement of said mounting means and said ski binding relative to said ski, said connecting means including a connecting piece separate from said mounting means connected to said ski binding and extending parallel to the longitudinal axis of said ski and vertically spaced above and free of engagement with the upper surface of the ski, and a releasable locking member mounted on said connecting piece for connecting said connecting piece to said mounting means and for facilitating an operative connection of said connecting piece to said base plate, said elongated slot in said base plate receiving said releasable locking member therein, means on the walls of said slot operatively connected to said releasable locking member to fixedly maintain said connecting piece and the connected mounting means and ski binding in a selected position relative to said ski.

2. The ski brake according to claim 1, wherein said bearing means on said mounting means includes first and second bearings horizontally spaced from one another in the longitudinal direction of said ski;

wherein each of said braking wings has at least two wire sections, a first wire section being connected to said pedal member through a first axle portion extending through said first bearing and a second section having a second axle portion at one end thereof received in said second bearing, a torsional bight portion connecting said first section to said second section at the ends thereof remote from said first and second bearings thereby defining said resilient means; and including means facilitating a movement of one of said first and second axle portions in one of said first and second bearings in a direction toward and away from the other of said first and second axle portions in response to a pivotal movement of said brake member between said retracted and braking positions, said other of said first and second axle portions defining the pivot axis for said brake member, said torsional bight portion providing a return force to urge said first and second axle portions away from each other and said brake member to said braking position whereat said first and second sections project beneath the lower surface of said ski.

* * * * *